US007818883B2

(12) United States Patent
Lax

(10) Patent No.: US 7,818,883 B2
(45) Date of Patent: Oct. 26, 2010

(54) SAFETY RAZOR

(75) Inventor: Samuel Lax, Mission Hills, CA (US)

(73) Assignee: L.I.F.E. Support Technologies, LLC, Mission Hills, CA (US)

( * ) Notice: Subject to any disclaimer, the term of this patent is extended or adjusted under 35 U.S.C. 154(b) by 0 days.

(21) Appl. No.: 12/177,754

(22) Filed: Jul. 22, 2008

(65) Prior Publication Data

US 2010/0018056 A1 Jan. 28, 2010

(51) Int. Cl.
*B26B 21/44* (2006.01)
*B26B 21/58* (2006.01)

(52) U.S. Cl. ..... 30/41; 30/50; 30/346.53

(58) Field of Classification Search ..... 30/41, 30/41.5, 50, 346.53
See application file for complete search history.

(56) References Cited

U.S. PATENT DOCUMENTS

| | | | | | |
|---|---|---|---|---|---|
| 851,341 | A | | 4/1907 | Bullard | |
| 1,875,990 | A | | 9/1932 | Christmas | |
| 2,048,419 | A | | 7/1936 | Wolfe | |
| 2,694,857 | A | | 11/1954 | Koval | |
| 2,716,810 | A | | 9/1955 | Koval | |
| 2,789,346 | A | | 4/1957 | Algier et al. | |
| 3,703,765 | A | | 11/1972 | Perez | |
| 3,985,146 | A | * | 10/1976 | Albach | 132/289 |
| 4,129,942 | A | * | 12/1978 | Denizman | 30/41 |
| D253,727 | S | | 12/1979 | Kowal | |
| 4,800,649 | A | * | 1/1989 | Cataudella | 30/41 |
| 4,809,432 | A | * | 3/1989 | Schauble | 30/41 |
| D312,893 | S | | 12/1990 | Hansen | |
| 5,018,274 | A | | 5/1991 | Trotta | |
| 5,048,191 | A | | 9/1991 | Hahn | |
| 5,056,227 | A | | 10/1991 | Kramer | |
| 5,121,660 | A | * | 6/1992 | Kramer | 76/104.1 |
| 5,141,694 | A | | 8/1992 | Butlin et al. | |
| 5,343,622 | A | * | 9/1994 | Andrews | 30/50 |
| 5,497,550 | A | * | 3/1996 | Trotta et al. | 30/50 |
| 5,604,983 | A | * | 2/1997 | Simms et al. | 30/49 |
| 6,260,280 | B1 | * | 7/2001 | Rapisardi | 30/357 |
| D475,159 | S | * | 5/2003 | Fisher | D28/48 |
| 7,060,367 | B2 | * | 6/2006 | Yamada et al. | 428/634 |
| 2002/0083600 | A1 | * | 7/2002 | Donovan | 30/526 |
| 2003/0208907 | A1 | * | 11/2003 | Brown et al. | 30/50 |
| 2003/0223802 | A1 | | 12/2003 | Biermann et al. | |
| 2005/0091855 | A1 | * | 5/2005 | Hannan | 30/346.5 |
| 2005/0131435 | A1 | | 6/2005 | Halecki et al. | |
| 2007/0283581 | A1 | | 12/2007 | Biermann et al. | |

* cited by examiner

*Primary Examiner*—Hwei-Siu C Payer
(74) *Attorney, Agent, or Firm*—Kelly Lowry & Kelley, LLP; Scott W. Kelley

(57) ABSTRACT

A disposable safety razor includes a blade housing and a blade disposed within the blade housing to expose a cutting edge suitable for shaving. The blade housing and the blade have complementary characteristics which result in destruction of the blade upon an attempt to remove the blade from within the blade housing. In this regard, the blade housing comprises a substantially rigid housing and the blade comprises a brittle ceramic blade. The safety razor further includes a handle attached to the blade housing. The handle is made from a pliable plastic material that forms an enclosure filled with a dispensable liquid.

18 Claims, 4 Drawing Sheets

SAFETY RAZOR

BACKGROUND OF THE INVENTION

The present invention relates to a disposable razor. More particularly, the invention relates to a disposable safety razor that shatters upon attempted removal from the razor head.

Hand-held articles such as toothbrushes, razors, writing instruments or utensils can be dangerous, when modified, especially in prisons or hospitals. For example, prison inmates may melt plastic toothbrushes into sharp objects for use as knives. Metal blades from shavers or razors may be extracted and attached to an elongated handle for use as a knife or other sharp weapon. Resourceful prison inmates can even modify plastic eating utensils such as knives, forks and spoons to produce weapons. Notably, prison inmates are extremely resourceful and frequently create dangerous weapons from the aforementioned everyday articles. These hand-held weapons can, in turn, be used to attack other inmates or even prison guards.

In particular, shaving razors are generally formed in two parts (1) a head portion made from a rigid plastic or metal body having a conventional razor blade or multiple razor blades mounted therein; and (2) a handle, typically fabricated from a robust, rigid material such as plastic. The shaving razor head and body are usually strong and only structurally fail under forces that far exceed those of everyday use. But, the blade mounted within the head portion is of particular concern because of the presence of an extremely sharp cutting blade. Often the blade can be easily extracted from the head and attached to another article as a weapon. These blades may even be designed to interchange so that the user may easily remove an old worn down blade with a new, sharp blade. Moreover, some head and body designs are frangible. Hence, metal razor blades mounted to a conventional head and handle are easily extractable therefrom. This is particularly dangerous as prison inmates and potentially suicidal hospital patients may easily extract and use the corresponding blade for unintended purposes. Utilizing easily breakable body or head portions with the razor blade assembly may actually increase the number of injuries in correctional facilities or hospitals because the blades may easily be removed.

Materially, most razor blades are formed from composite or alloy metal materials. Razor blades have also been manufactured from other types of materials, including ceramic, glass or other vitreous materials. Thus, a variety of non-metallic blade constructions are available in the prior art. But, manufacturing razors having blades other than metal require a host of fabrication steps. For instance, glass blades are especially difficult to mass produce and assemble. It is difficult to fuse together a plurality of separate glass elements. Glass, once formed, is not easily manipulated. Ideally, glass is fused or formed immediately into the final razor blade assembly, such as being immediately mounted to the head portion of the razor blade assembly. Manufacturing a blade that requires a complex assembly process is accordingly more expensive to mass produce than other, simpler, razor blades. Not surprisingly, simple disposable metallic-based razors dominate current market sales.

Even simple metallic razor blade assemblies require several manufacturing, processing and assembly steps. The overall assembly process may require that individual and partially assembled parts be passed through several workstations before being finally assembled and ready for sale. Razor blade assemblies usually comprise, as described above, at three portions—including a body portion and a head portion with a blade mounted therein. The head portion may include a slot for permanently or interchangeably securing a blade or plurality of blades therein. The handle portion may be molded from or engaged to the head portion by any means known in the art. Some manufacturing techniques known in the art mold a thermoplastic material around opposite side edges of the blades. The elongated and sharpened edges of the blades remain protected during the assembly process. A selectively removable cap may be attached to the head to protect the otherwise exposed blades.

One common manufacturing problem associated with metallic-based razors is consistent blade performance. In particular, specific spatial positioning of metallic razor blades in the head portion of the razor assembly dictates the angles at which the blades contact the skin. This directly affects shave performance. The quality of razor fabrication and subsequent assembly can affect the consistency at which the blades are assembled into the razor head. Notably, shave performance relates to blade response during shaving, which is at least partially based on the placement of the blades in the head. Sometimes users undesirably experience vibrations of the blades during shaving. This is commonly referred to as "chatter". Chatter detracts from the overall "smoothness" of the shave. Separate fabrication and assembly steps typically contribute to chatter. Mass manufacturing of razor blades has improved over the years through the use of plastic parts and injection molding. Accordingly, manufacturers are able to produce more consistently dimensioned products using these manufacturing techniques. One drawback, however, is that these plastic parts are only used for the head and body portions of the razor assembly and do not significantly improve blade performance.

Another drawback of metallic-based blades is that the razor blade itself tends to bend during shaving. Ideally, the blade remains consistently flat and maintains a straight profile relative to the shaving surface during shaving. Flexible metallic-based blades tend to deviate out from such a fixed geometry of the razor head as the blade tends to bend near its midpoint in response to counter-active forces along the shaving surface. Consequently, matching mating parts of the razor assembly must be carefully aligned during assembly. Adequate care may require labor intensive quality assurance measures, which ultimately increase the cost of manufacturing.

Another drawback of the aforementioned razor blade assemblies includes vibrations among various subcomponents and vibrations of the actual razor blade assembly itself during shaving. Vibrations among subcomponents of the razor blade assembly are commonly referred to as "clam-shelling." Clam-shelling may occur, for example, between loose fitting sections of the head and body portions of the razor blade assembly. In this instance, the head may vibrate back and forth relative to the body. Another undesirable vibration is associated with the cantilever design of most convention razor blade assemblies. In this case, the user applies a force at one end of the body portion such that the head portion, containing the blades therein, contacts the shaving surface. The blades, as described above, attach to and are supported at opposite edges of the head portion. The blades are generally less supported away from the edges of the head toward the midpoint of the blades thereof. The stiffness of the blades ultimately determines the amount the blades are able to bend. Rapid bending and returning of the blades themselves can cause vibration because the head and corresponding blades do not remain flush with the shaving surface. In this case, the cantilever configuration of the razor blade assembly allows the head and corresponding blades to undesirably hop or vibrate along the shaving surface.

Disposable shaving razors known in the art also include mechanisms for retaining shaving cream in the body portion of the razor. In one prior art device, the shaving cream manually dispenses by telescopic movement of a handle over a central stem of the razor. Accordingly, the shaving cream dispenses through an aperture in the head of the razor. A pressure sensitive adhesive coats the surface around the aperture for sealing the dispensing aperture prior to use of the razor. But, this prior art device must be sealed together in several different layers to contain and hold the shaving cream. Moreover, the telescopic handle and central stem must be rigid and could be used as a weapon by inmates, similar to a toothbrush handle.

Thus, there exists a significant need for a disposable razor that cannot be manipulated into a weapon and includes a blade that breaks with attempted removal therefrom. Such an improved razor blade assembly should include a pliable plastic handle for retaining shaving cream therein and a hard plastic housing for retaining a ceramic blade such that the ceramic blade shatters into useless fragments upon attempted removal from the housing. Moreover, the improved razor blade assembly should be easy to manufacture, require few assembly steps and be cost effective. The present invention fulfills these needs and provides further related advantages.

SUMMARY OF THE INVENTION

The present invention for a safety razor includes a blade housing and a blade disposed within the blade housing positioned therein to expose a cutting edge suitable for shaving. The blade housing and the blade have complementary characteristics which result in destruction of the blade upon attempted removal of the blade from within the blade housing. The blade housing itself comprises a substantially rigid plastic material molded over the blade. Furthermore, the blade housing may also include a carriage extending away from the handle to optimize contact of the cutting edge with a shaving surface. The blade, or a plurality of blades, disposed within the blade housing may comprise a brittle ceramic material that includes silicon carbide, silicon nitride, mullite, hafnia, yttria, zirconia or alumina.

Additionally, the safety razor of the present invention may also include a handle attached to the blade housing. Preferably, the handle comprises a pliable plastic material and forms an enclosure filled with a dispensable liquid. A selectively removable stop integral to the handle provides access to the dispensable liquid within the enclosure. The dispensable liquid may include a shaving gel, a shaving cream, a shaving oil, a lotion, an aftershave or a soap.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
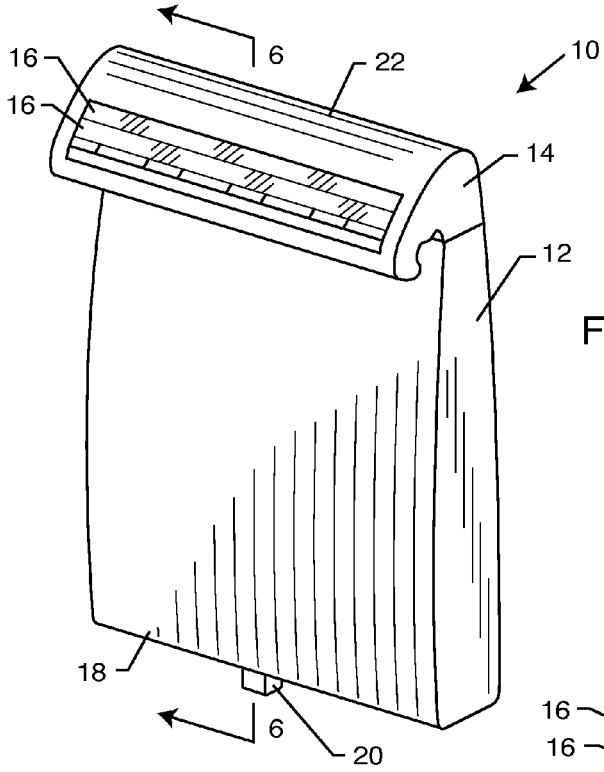
FIG. 1 is a perspective view of a disposable razor, in accordance with the present invention.

As shown in the drawings for purposes of illustration, the present invention for a disposable razor is referred to generally by the reference number 10. In FIG. 1, the disposable razor 10 generally includes a body 12 and a head 14 for retaining a ceramic blade 16 or a plurality of ceramic blades 16. The disposable razor 10 of the present invention is ideal for gift packs for hotels, motels, hospitals, airlines and for other company or product advertisements, or give-away toiletry items for hotel guests. For example, a logo or other advertisement may be applied to the body 12. The disposable razor 10 of the present invention is particularly ideal for use in prisons and hospitals as the ceramic blade 16 shatters upon attempted removal from the head 14, as described in more detail below. Hence, the disposable razor 10 could save thousands of dollars in medical expenses from injuries related to blades that could previously be extracted from the head 14 and used as weapons. For example, inmates and suicidal hospital patients would no longer be able to extract the ceramic blade 16 from the head 14 for use as a weapon or to impose self-inflicted wounds.

The overall size of the disposable razor 10 is preferably close to that of a common book of matches. In a particularly preferred embodiment, the disposable razor 10 is one and thirteen-sixteenth inches in length, one and one-half inches in width and one-fourth inch thick at a bottom end 18 having a breakaway nib 20. Moreover, the disposable razor 10 is preferably approximately one-fourth to five-sixteenths inches thick at a top end 22 where the ceramic blade 16 is affixed to the head 14. Thus, the overall size of the disposable razor 10 is ideal for traveling or for use in small areas, such as a hotel room or prison bathroom. The disposable razor 10 may also be grouped with other toiletry items provided to hotel guests, provided in a gift pack or sold in a travel pack.

Figure 2:
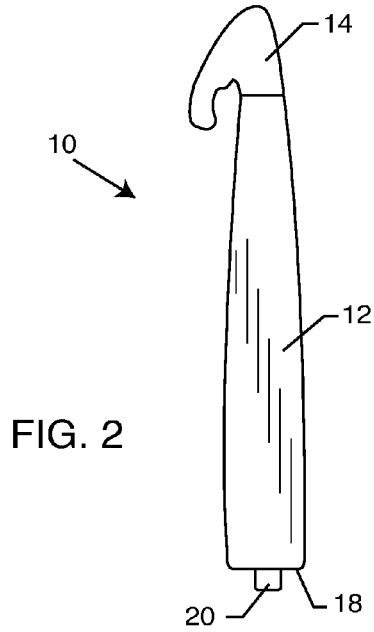
FIG. 2 is a side view of the disposable razor of FIG. 1.
Figure 4:
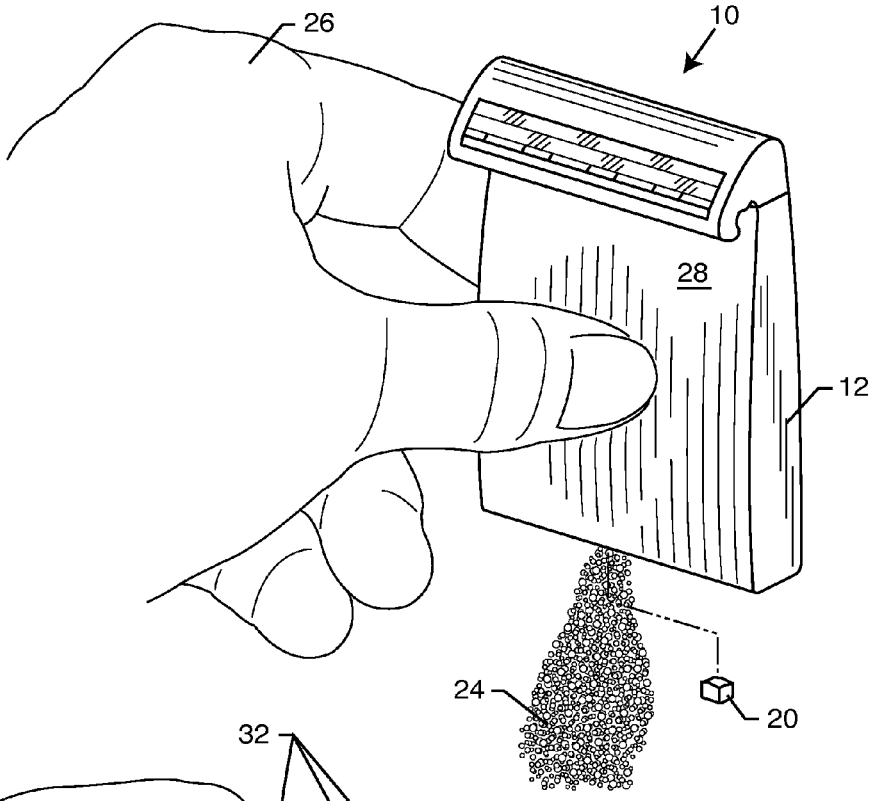
FIG. 4 is a perspective view of the disposable razor, illustrating dispensing shaving cream after removal of a nib.

As shown in FIG. 2, the body 12 generally tapers outwardly from the head 14 toward the bottom end 18. The body 12 is preferably manufactured from a pliable plastic material that can be deformed by being squeezed. The body 12 should be flexible enough such that after the nib 20 breaks away from the body 12 (FIG. 4) a shaving solution 24 may be dispensed therefrom. FIG. 4 specifically illustrates a user hand 26 grasping a front portion 28 and a rear portion 30 (not shown) of the body 12 to dispense the shaving solution 24 therefrom.

Figure 3:
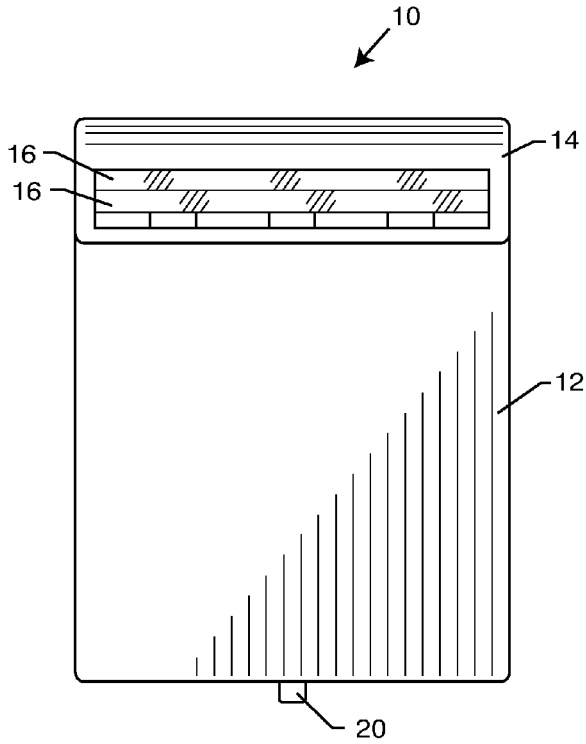
FIG. 3 is a front view of the disposable razor of FIG. 1.

FIG. 3 illustrates a front view of the disposable razor 10, in accordance with the present invention. In this embodiment, the head 14 includes a pair of ceramic blades 16 mounted therein. The head 14 is preferably manufactured from a hard plastic material that encases at least the external ends of the ceramic blades 16. Preferably, the head 14 is manufactured using an injection molding machine capable of casting (injecting) twenty-four units at a time. This is accomplished by first mounting one or more of the ceramic blades 16 in an injection molding die. Thereafter, hot injection molding material is rapidly injected into the die and molded around the ceramic blades 16 to form the disposable razor 10 generally shown in FIG. 3. The head 14 cools into a hardened plastic material substantially resilient to bending or flexing. Of course, the injection molding die would be designed to retain standard size razors (i.e. the ceramic blades 16) as most single edge, double edge and injection molding blades are the same width—i.e. the width of a standard book of matches. Moreover, the head 14 is curved (see FIG. 2) similar to that of a bent book of matches. This angle is the preferred shaving angle for use with the disposable razor 10 of the present invention. The head 14 may be manufactured from a hard plastic material similar to that used with conventional metallic-based razors.

FIG. 3 also illustrates the wide body configuration of the body 12. The body 12 is different from conventional razors known in the art because the width of the body 12 extends approximately the width of the head 14 and the ceramic blades 16. Conventional razors have long and skinny handles. The head portion of conventional razors is therefore more difficult to control and maneuver during shaving. The wide base of the body 12 provides enhanced control during shaving. Notably, the body 12 includes a larger surface area to grasp, which stabilizes movement of the disposable razor 10 during shaving and prevents undesirable vibrations.

Figure 5:
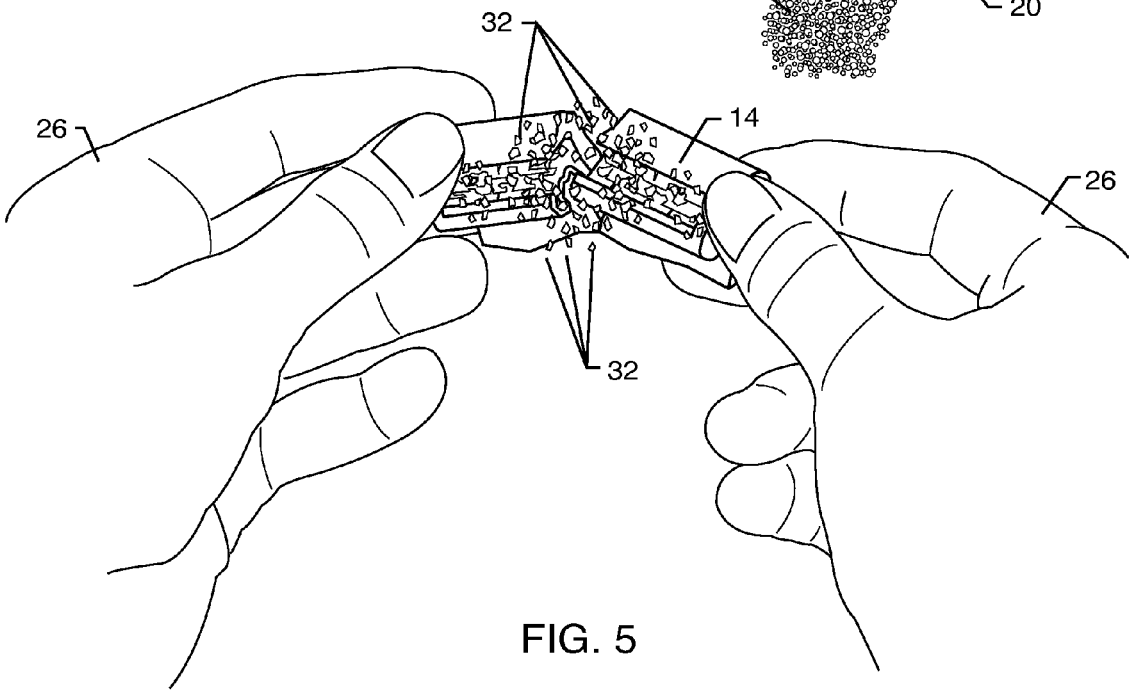
FIG. 5 illustrates shattering a ceramic razor blade upon attempted removal from a rigid plastic housing.

The ceramic blade 16 mounts to the head 14, which is manufactured from a hard plastic material as described above. The interplay between the ceramic blade 16 and the plastic head 14 makes it impossible to extract the ceramic blade 16 therefrom without completely shattering or destroying the ceramic blade 16. FIG. 5 illustrates a user having removed the head 14 from the body 12. In FIG. 5, a pair of hands 26 bend the head 14 near its longitudinal mid point. The force required to break the plastic material of the head 14 is much greater than any force used during shaving. The ceramic blade 16 is locked within the plastic material comprising the head 14 during the molding process, as previously described. Attempting to remove the ceramic blade 16 as shown in FIG. 5 causes, not only the head 14 to snap into pieces, but also causes the ceramic blade 16 to shatter into a plurality of pieces 32. In fact, simply twisting or even bending the head 14, without breaking it, causes the ceramic blade 16 to shatter. The ceramic blade 16 shatters into the plurality of pieces 32 based on the brittle material properties of the ceramic that comprises the ceramic blade 16. This aspect of the disposable razor 10 of the present invention effectively prevents a prison inmate or a mental health facility patient from bending or breaking the head 14 and extracting the ceramic blade 16 therefrom. Accordingly, the pieces 32 are completely useless fragments of the original ceramic blade 16. The pieces 32 cannot be used as a weapon as could conventional metallic-based razors extracted from a head portion thereof.

Figure 6:
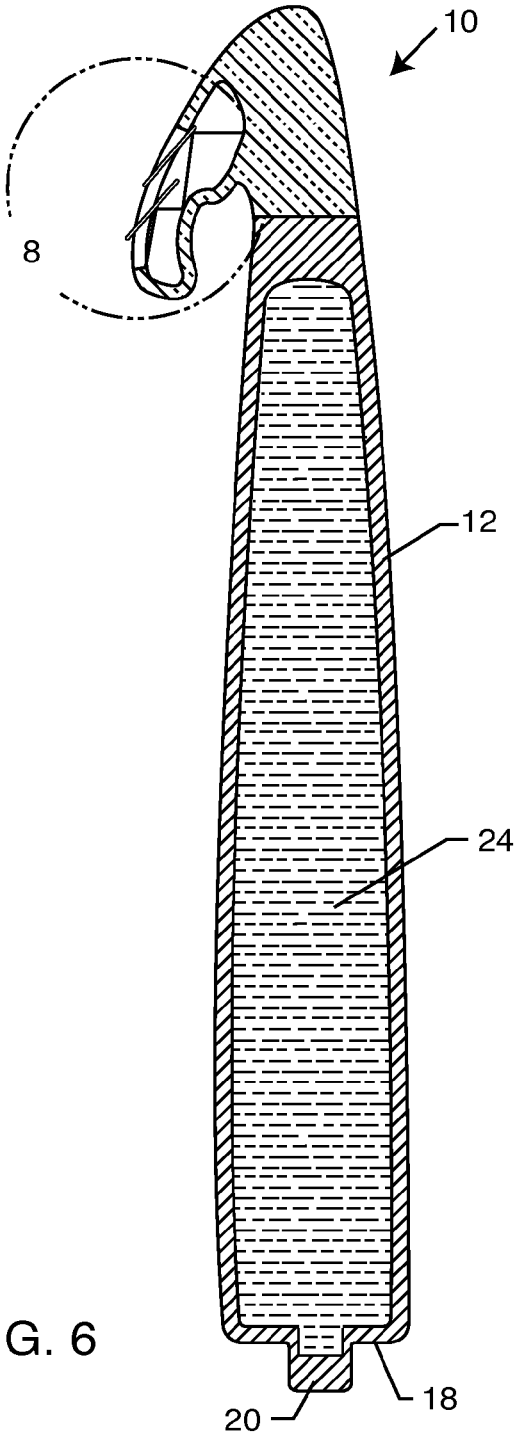
FIG. 6 is a cross-sectional view of the disposable razor, taken about the line 6-6 of FIG. 1.
Figure 7:
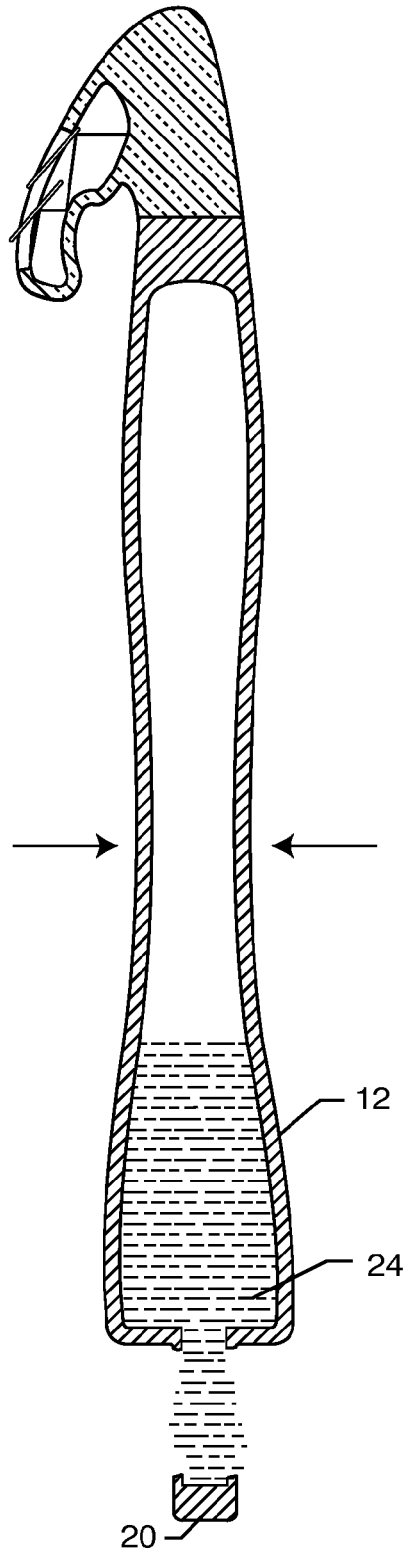
FIG. 7 is another cross-sectional view of the disposable razor, illustrating nib removal and dispensing of the shaving cream.

FIG. 6 illustrates a cross-sectional view of the disposable razor 10 having the shaving solution 24 within the body 12. As shown, the nib 20 extends from the bottom end 18 of the body 12 to be selectively removed therefrom when the contents (i.e. the shaving solution 24) is desirably accessed. In application, a user breaks the nib 20 away from the body 12 as shown in FIG. 7. The body 12 is then compressed along the directional arrows generally shown in FIG. 7 to dispense the shaving solution 24 from within the interior of the body 12. The pliable plastic material that comprises the body 12 compresses as shown between FIGS. 6 and 7. The shaving solution 24 may include any type of liquid, including shaving gel, aftershave, shaving cream, shaving oil, lotion or soap. Appropriately, the nib 20 may be broken away from the body 12 either before shaving, in the case of shaving gel, or after a shave, in the case of aftershave. The nib 20 may, alternatively, be a cap or other removable device capable of retaining the shaving solution 24. Another aspect of the body 12 is that it cannot be readily made into an elongated and substantially hardened weapon as can be done with conventional razor blade handles. As such, the pliable plastic material that comprises the body 12 is preferably soft and flexible as previously described. The body 12 does not include any elongated sections of rigid plastic that could be removed from the head 14 and melted or sharpened at one end into a weapon that could be used to poke or stab someone.

Figure 8:
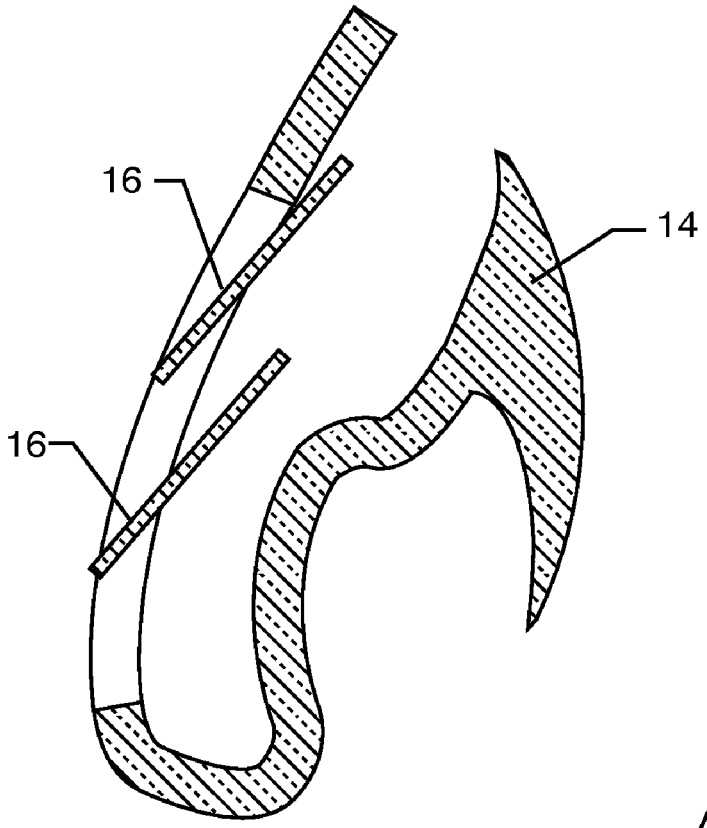
FIG. 8 is an enlarged partial cross-sectional view of a pair of ceramic razor blades mounted in the plastic housing, taken about the circle 8 of FIG. 6.
Figure 9:
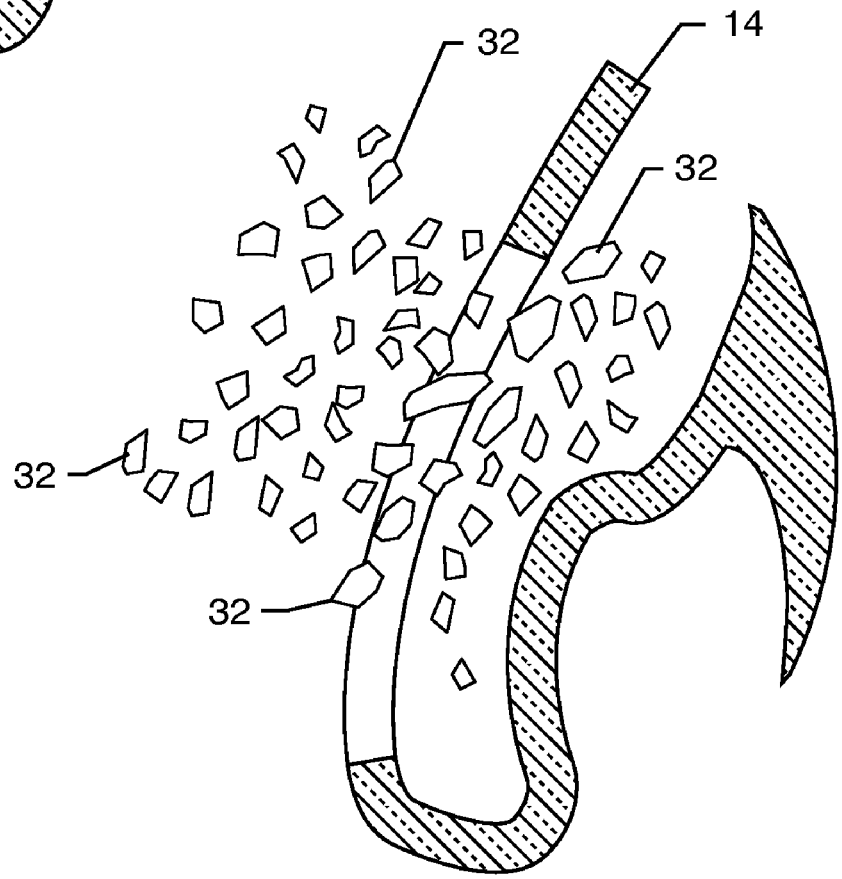
FIG. 9 is an enlarged cross-sectional view of the plastic housing, illustrating shattering of the ceramic razor blades therein.

FIGS. 8 and 9 illustrate a pair of ceramic blades 16 mounted to the head 14. As shown in FIG. 8, the ceramic blades 16 mount within the head 14 at an angle to enhance the comfort of the shave. The ceramic blades 16 are approximately twice as hard as stainless steel and can withstand extremely high temperatures. But, the ceramic blades 16 cannot withstand minor deformation (e.g. twisting). The inherent brittleness of ceramic material causes the ceramic blades 16 to break into the pieces 32 (FIG. 9) when the head 14 is twisted, distorted or otherwise broken in half (FIG. 5). Ceramic is a particularly ideal material for use as a razor blade. In this instance, ceramic has desirable properties of high strength, hardness and corrosion resistance and can be manufactured to provide a satisfactory sharp shaving edge. Moreover, ceramic blades offer precise blade extension with cleaner, sharper cutting edges than conventional metal-based razor blades. Ceramic is also resistant to bending, unlike metallic-based blades. Thus, the entire length of a ceramic blade is engageable with the shaving surface, unlike metallic-based blades which may bend or bow in a middle, unsupported area of the razor blade assembly. Accordingly, this enhanced support and resistance to bending helps prevent and eliminate the aforementioned and undesirable vibrational characteristics often associated with metallic-based razor blades. Moreover, over time, steel materials often exhibit increased strength in the work area (e.g. the sharpened edge) from extensive use. Ceramic material subjected to similar operation does not exhibit similar material strengthening in the work area because ceramic is considerably more brittle and does not bend under similar loads. Thus, ceramics are much more susceptible, relative to metal-based razor blade edges, to fracture-type breakage. This is particularly ideal in the present invention as the ceramic blades 16 are well suited for limited or one-time use in a prison or mental facility where inmates or patients of these institutions are unable to remove the ceramic blade 16 from the head 14 absent shattering the ceramic blade 16 into a plurality of pieces 32 (FIG. 9). Hence, the ceramic blade 16 cannot be removed and used to injure others or to inflict wounds, such as in an attempted suicide. Rather, ceramic blades 16 shatter into the useless pieces 32 upon attempted removal from the head 14.

The ceramic blade 16 may be manufactured from any one of a plurality of polycrystalline ceramic substrate materials. Such materials may include silicon carbide, silicon nitride, mullite, hafnia, yttria, zirconia or alumina. Alternatively, the ceramic blades 16 could comprise polycrystalline ceramic substrate materials being adhered in alumina and hot isostatically-pressed tetragonal zirconia. The abraded edge of the ceramic blade 16 may then be subjected to heat-treatment, referred to as "annealing". Annealing reduces surface raggedness and substrate defects resulting from initial mechanical abrasion manufacturing. Once complete, the ceramic blade 16 remains brittle relative to the head 14 and shatters upon attempted removal once molded to the head 14.

Although several embodiments have been described in some detail for purposes of illustration, various modifications may be made to each without departing from the scope and spirit of the invention. Accordingly, the invention is not to be limited, except as by the appended claims.

What is claimed is:

1. A safety razor, comprising:

a plastic blade housing;

a pliable plastic enclosure attached to and supportive of the blade housing during shaving; and a ceramic blade disposed within the blade housing to expose a cutting edge suitable for shaving;

wherein the blade housing at least partially encases the external ends of the ceramic blade to non-removably lock the blade therein, and wherein simply twisting or bending the plastic blade housing, without breaking it, causes the ceramic blade to shatter.

2. The safety razor of claim 1, wherein the blade housing comprises a substantially rigid housing.

3. The safety razor of claim 1, wherein the ceramic blade comprises silicon carbide, silicon nitride, mullite, hafnia, yttria, zirconoia or alumina.

4. The safety razor of claim 1, wherein the blade housing comprises a carriage extending away from the enclosure to optimize contact of the cutting edge with a shaving surface.

5. The safety razor of claim 1, wherein the enclosure is filled with a dispensable liquid.

6. The safety razor of claim 5, including a selectively removable stop providing access to the dispensable liquid within the enclosure.

7. The safety razor of claim 6, wherein the liquid comprises a shaving gel, a shaving cream, a shaving oil, a lotion, an aftershave or a soap.

8. The safety razor of claim 1, wherein the blade housing comprises a plastic material molded over the blade.

9. The safety razor of claim 1, including a plurality of blades disposed within the blade housing.

10. A safety razor, comprising:

a substantially rigid plastic blade housing;

a pliable plastic enclosure attached to and supportive of the blade housing during shaving; and a ceramic blade disposed within the blade housing to expose a cutting edge suitable for shaving, wherein the ceramic blade has a compressive strength, a flexural strength and a tensile strength less than the blade housing;

wherein the blade housing at least partially encases the external ends of the ceramic blade to non-removably lock the blade therein, and wherein simply twisting or bending the substantially rigid plastic blade housing, without breaking it, causes the ceramic blade to shatter.

11. The safety razor of claim 10, wherein the blade housing comprises a carriage extending away from the enclosure to optimize contact of the cutting edge with a shaving surface.

12. The safety razor of claim 10, wherein the blade housing comprises a plastic material molded over the ceramic blade.

13. The safety razor of claim 10, wherein the ceramic blade comprises silicon carbide, silicon nitride, mullite, hafnia, yttria, zirconoia or alumina.

14. The safety razor of claim 13, including a plurality of ceramic blades disposed within the blade housing.

15. The safety razor of claim 10, wherein the enclosure includes a selectively removable stop providing access to a dispensable liquid within the enclosure, the liquid comprises a shaving gel, a shaving cream, a shaving oil, a lotion, an aftershave or a soap.

16. A safety razor, comprising:

a substantially rigid plastic blade housing molded over a plurality of ceramic blades to expose a cutting edge suitable for shaving; and a pliable plastic enclosure attached to and supportive of the blade housing during shaving;

wherein the blade housing at least partially encases the external ends of the ceramic blades to non-removably lock the ceramic blades therein, and wherein simply twisting or bending the plastic blade housing, without breaking it, causes the ceramic blade to shatter.

17. The safety razor of claim 16, wherein the enclosure includes a selectively removable stop providing access to a dispensable liquid within the enclosure, wherein the liquid comprises a shaving gel, a shaving cream, a shaving oil, a lotion, an aftershave or a soap.

18. The safety razor of claim 16, wherein the blade housing comprises a carriage extending away from the enclosure to optimize contact of the cutting edge with a shaving surface and the ceramic blades comprise silicon carbide, silicon nitride, mullite, hafnia, yttria, zirconoia or alumina.

* * * * *

UNITED STATES PATENT AND TRADEMARK OFFICE

CERTIFICATE OF CORRECTION

PATENT NO. : 7,818,883 B2
APPLICATION NO. : 12/177754
DATED : October 26, 2010
INVENTOR(S) : Samuel Lax It is certified that error appears in the above-identified patent and that said Letters Patent is hereby corrected as shown below:

In Column 7, lines 41-44 (claim 10), delete “, wherein the ceramic blade has a compressive strength, a flexural strength and a tensile strength less than the blade housing”.

Signed and Sealed this
Fourteenth Day of June, 2011

David J. Kappos

David J. Kappos
*Director of the United States Patent and Trademark Office*